US006003858A

United States Patent [19]

Gunschera et al.

[11] Patent Number: 6,003,858

[45] Date of Patent: Dec. 21, 1999

[54] CHAIN CONVEYOR FOR TRANSPORTING SHEETS IN A PRINTING PRESS

[75] Inventors: Frank Gunschera, Nussloch; Thomas Schmidt, Eppelheim, both of Germany

[73] Assignee: Heidelberger Druckmaschinen AG, Heidelberg, Germany

[21] Appl. No.: 09/195,489

[22] Filed: Nov. 18, 1998

[30] Foreign Application Priority Data

Nov. 18, 1997 [DE] Germany ..... 197 51 119

[51] Int. Cl.[6] ..... B65H 3/44; B65H 5/26

[52] U.S. Cl. ..... 271/204; 198/407.1

[58] Field of Search ..... 198/803.7, 470.1, 198/867.15, 867.05; 271/204, 206, 277

[56] References Cited

U.S. PATENT DOCUMENTS

| | | | |
|---|---|---|---|
| 4,735,142 | 4/1988 | Haupenthal | 101/246 X |
| 5,289,768 | 3/1994 | Keller | 101/137 X |
| 5,611,280 | 3/1997 | Orlandini | 101/409 X |
| 5,697,490 | 12/1997 | Raque | 198/803.9 |
| 5,823,526 | 10/1998 | Voge et al. | 271/204 |

*Primary Examiner*—William E. Terrell
*Assistant Examiner*—Kenneth W. Bower
*Attorney, Agent, or Firm*—Herbert L. Lerner; Laurence A. Greenberg

[57] ABSTRACT

A chain conveyor for transporting sheets in a printing press. The chain conveyor includes two conveyor chains disposed opposite one another and revolving together during operation, and at least one gripper bar extending in a direction transverse to and between the two conveyor chains. An expansion joint is provided to connect one end of the gripper bar to one of the conveyor chains and to allow movement of the gripper bar in the direction transverse to the two conveyor chains. The expansion joint may also allow rotational movement of the gripper bar. The expansion joint reduces wear of the conveyor chains by allowing the gripper bar to move.

3 Claims, 7 Drawing Sheets

S
3
5
2
6
4
1
2
5
7

3′
10
9
8
4′
1
12
11
9
7

3´´
4´´
17
13
7
1´

3´´´
4´´´
8´
15
17
14
16
1
7

3''''
8''
15
17
14
16
1
7
4'''

CHAIN CONVEYOR FOR TRANSPORTING SHEETS IN A PRINTING PRESS

BACKGROUND OF THE INVENTION

Field Of The Invention

The invention relates to a chain conveyor for transporting sheets in a printing press, having two conveyor chains disposed opposite one another and revolving together during operation, and at least one gripper bar extending in the longitudinal direction thereof between the two conveyor chains and being connected at a respective end thereof to one of the conveyor chains, and also relates to a sheet-processing printing press equipped with the chain conveyor.

A chain conveyor of the aforementioned type has been disclosed heretofore, for example, in the published European Patent Document EP 0 669 210 A1. In this regard, a connection between a conveyor chain and the gripper bar is produced by a carrier which is divided into two parts of which a first part is connected to the gripper bar and a second part to the conveyor chain, the two parts being received telescopically in one another in a direction parallel to the travel path of the conveyor chain and being threadedly secured or screwed to one another in the direction in which they are joined.

Therewith, and indeed in the unscrewed condition thereof, i.e., in the condition thereof that is not suitable for the intended operation of the chain conveyor, the gripper bar can easily be disassembled by displacing it parallel to the travel path of the conveyor chain, if it should have become damaged due to a process failure and requires replacement or repair.

The gripper bars of the foregoing chain conveyors carry grippers which close under spring force and which, when in operation, are opened periodically, so that periodic gripper opening forces act upon the conveyor chains. With regard to the heretofore known chain conveyors of the type mentioned in the introduction hereto, these gripper opening forces are absorbed by chain guide tracks, as are centrifugal forces occurring in the returning or reversing regions of the conveyor chains. In order to avoid over-dimensioning of the width of the chain guide track and the length of the chain rollers of the roller chains which are employed as conveyor chains in the case of the foregoing chain conveyors so as to attain an acceptable pressure between the chain guide track and the chain rollers, it is therefore desirable to support the chain rollers on the chain guide tracks as much as possible over the entire extent thereof between the inner fitting plates of the roller chains. This is countered, however, by the fact that, in this case, particularly at the side surfaces of the chain guide tracks which face the gripper bar, considerable wear occurs if, as a result of production and installation tolerances, stresses occur between the chain guide tracks and the conveyor chains.

SUMMARY OF THE INVENTION

It is accordingly an object of the invention to provide a chain conveyor for transporting sheets in a printing press, which is constructed in such a manner as to be subjected to as little wear as possible.

With the foregoing and other objects in view, there is provided, in accordance with one aspect of the invention, a chain conveyor for transporting sheets in a printing press, having two conveyor chains disposed opposite one another and revolving together during operation, and at least one gripper bar extending in the longitudinal direction thereof between the two conveyor chains and being connected at a respective end thereof to one of the conveyor chains, comprising a connection having an expansion joint extending transversely to the longitudinal direction of the gripper bar, the connection being disposed between one of the conveyor chains and the gripper bar.

In accordance with another feature of the invention, the chain connection between the one conveyor chain and the gripper bar is formed by a swivel joint having a swivel axis oriented in the longitudinal direction of the gripper bar.

In accordance with a concomitant aspect of the invention, there is provided, in a sheet-processing printing press, a chain conveyor for transporting sheets in the printing press, having two conveyor chains disposed opposite one another and revolving together during operation, and at least one gripper bar extending in the longitudinal direction thereof between the two conveyor chains and being connected at a respective end thereof to one of the conveyor chains, comprising a connection having an expansion joint extending transversely to the longitudinal direction of the gripper bar, the connection being disposed between one of the conveyor chains and the gripper bar.

By this construction, stress between the chain guide tracks and the conveyor chains, which leads to wear of the side faces of the chain guide tracks, is avoided in a particularly simple manner. Utilizing the expansion joint with an appropriate dimensioning thereof, it is also possible, in particular, to absorb a thermal expansion of the gripper bars.

An improved feature of the invention provides for the connection between one conveyor chain and the gripper bar to be produced by a swivel or articulating joint having a swivel or pivot axis oriented in the longitudinal direction of the gripper bar. This measure additionally prevents stresses which act in the form of torsion of the gripper bar in relation to the longitudinal axis thereof and which, in the case of conventional chain conveyors, could only be countered by an otherwise disadvantageous increase in the spaced distance between an inner and an outer chain guide track.

The increase in the distance between an inner and an outer chain guide track proves to be disadvantageous, in the case of conventional chain conveyors, specifically in relation to those stresses which lead to wear of the side faces of the chain guide tracks because, in the case of an increased distance, the chain fitting plates which are decisive for the lateral guidance of the conveyor chain are presented with a lower contact surface on the chain guide track.

Other features which are considered as characteristic for the invention are set forth in the appended claims.

Although the invention is illustrated and described herein as embodied in a chain conveyor for transporting sheets in a printing press, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, wherein:

DESCRIPTION OF THE PREFERRED EMBODIMENTS

Figure 1:
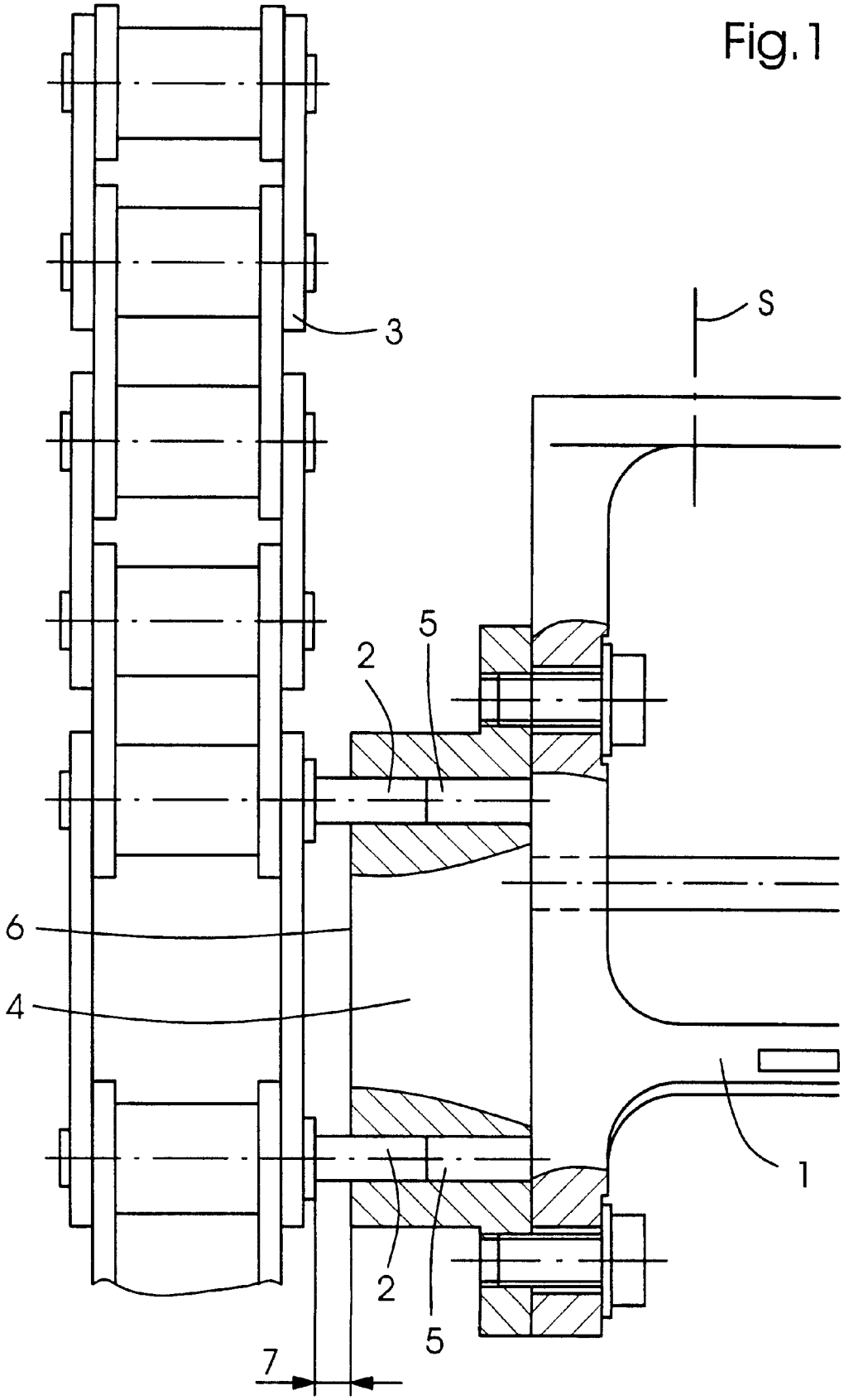
FIG. 1 is a fragmentary plan view, partly broken away and in section, of a conveyor chain provided with a first exemplary embodiment of a first conception of a connection to a gripper bar, with an expansion joint, and having only one degree of freedom in the longitudinal direction of the gripper bar.

Referring now to the drawings and, first, particularly to FIG. 1 thereof, there is shown therein a gripper bar 1 carried by two link pins 2 of a conveyor chain 3 in the form of a roller chain. In this regard, a respective link pin 2 is assigned to one of the mutually facing pairs of aligned drilled holes or boreholes of successive pairs of inner connecting links of the roller chain or, in other words, the respectively aligned drilled holes in a pair of outer fitting plates of the roller chain, and a respective link pin 2 is formed with an added length extending in a direction towards the gripper bar 1, beyond the respective outer fitting plate facing towards the gripper bar 1. Fastened to an end of the gripper bar 1 which faces towards the conveyor chain 3 is a coupling member 4 which is provided with drilled holes 5 open at least in the direction towards the conveyor chain 3 and matching the diameter of the added length of the respective link pin 2 for displaceably accommodating a respective one of these added lengths of the respective link pins 2 in the longitudinal direction of the drilled holes 5.

The coupling member 4 and the gripper bar 1 are dimensioned in the longitudinal direction of the latter so that an expansion joint 7 is formed between the conveyor chain 3 and an end face of the coupling member 4 facing towards the conveyor chain 3, and thus extends transversely to the longitudinal direction of the gripper bar 1.

In the case of a printing press which processes sheets with a relatively large format, the gripper bars carry an appropriately greater number of grippers than in the case of a printing press which processes sheets with a relatively small format. Accordingly, in the foregoing first-mentioned case, relatively high gripper opening forces also result. These are usually produced by deflecting a roller lever which opens the grippers counter to a spring force closing the latter, and produces on the gripper bar 1 a tilting moment relative to a longitudinal axis thereof, as well as reaction forces resulting therefrom, which then, in the case of the exemplary embodiment illustrated in FIG. 1, have to be absorbed, via the two elongated link pins 2, and finally via the chain rollers assigned to the latter, on a chain guide track which is not illustrated in FIG. 1. Because the magnitude of these reaction forces can be influenced by the mutual spacing between the two link pins 2, in the case of a printing press processing large-format sheets, provision is preferably made for a special chain link which includes the aforementioned two link pins 2 and in which the spaced distance between the link pins is greater than one graduation or division of the conveyor chain. In this case, the spaced distance is selected to be precisely so large that when the conveyor chain runs onto a sprocket, the chain roller assigned to the subsequent link pin is inserted into a tooth gap in the sprocket which has a spaced distance of two graduations or divisions from the chain roller assigned to the preceding link pin.

A special chain link of this type is provided in the exemplary embodiment according to FIG. 1, so that this constitutes a preferred configuration for use in large-format printing presses.

Figure 2:
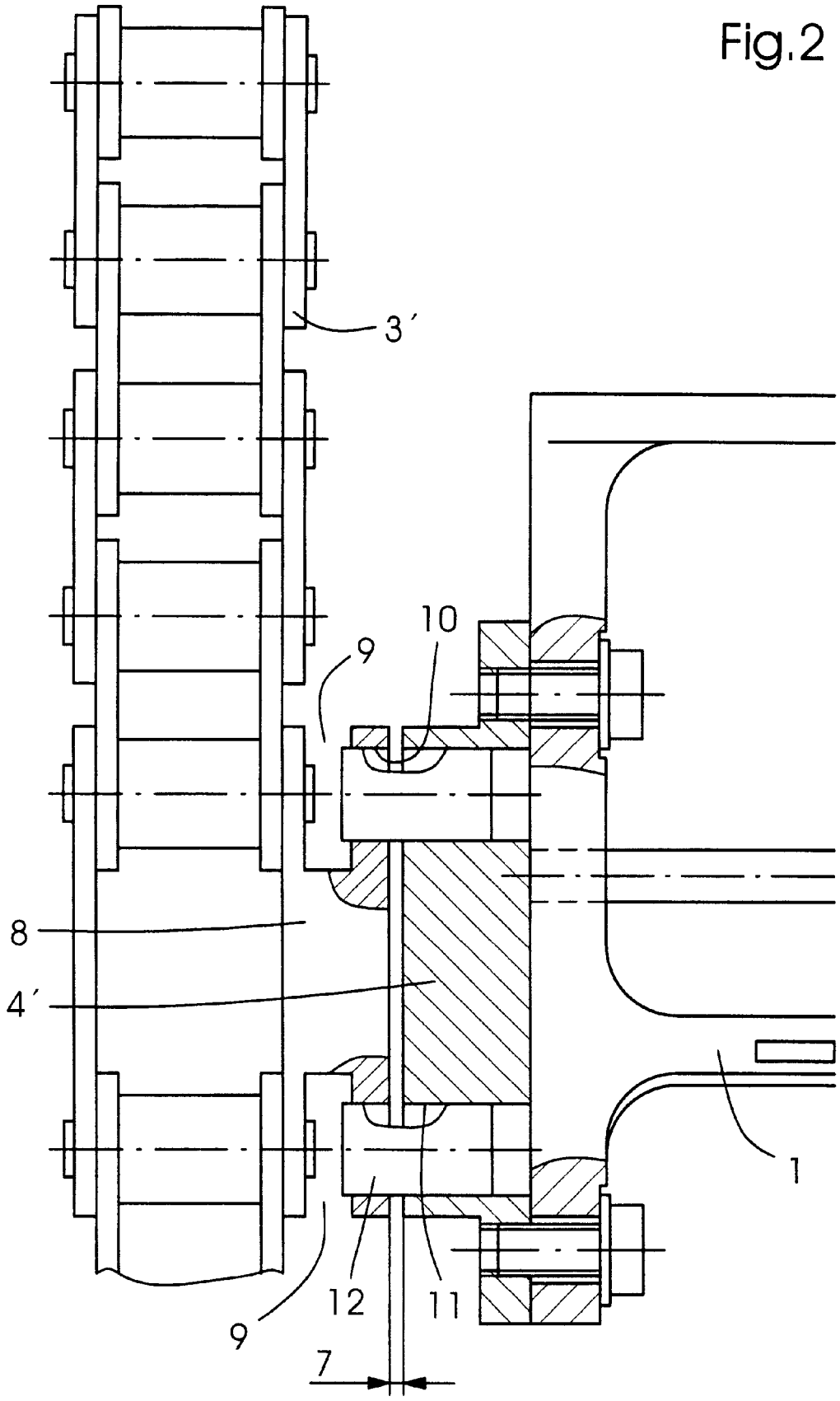
FIG. 2 is a view like that of FIG. 1 showing a second exemplary embodiment of the first conception of the connection having one degree of freedom in the longitudinal direction of the gripper bar.

The conveyor chain 3' of the exemplary embodiment according to FIG. 2 also has a special chain link which, between the link pins thereof, is provided with an increased spaced distance between the link pins thereof, so that this exemplary embodiment likewise constitutes a preferred configuration for use in large-format printing presses.

While the special chain link in the configuration according to FIG. 1 has, in addition to the added lengths of the link pins, fitting plates that are increased in length only by comparison with the chain links that are not connected to the gripper bar 1, in the case of the configuration according to FIG. 2, the special chain link carrying the gripper bar 1 is equipped with a particularly shaped special fitting plate, which makes it possible to use link pins without an added length thereof, even in the case of the special chain link. This special fitting plate 8, as viewed in the longitudinal direction of the gripper bar 1, may certainly have the same contour as the lengthened fitting plates according to FIG. 1; however, it has a thickness which is a multiple of that of the latter and, at a respective one of the ends thereof that is connected to a link pin, is formed with a cutout 9 such that a first remaining part of the thickness precisely corresponds to that of the outer plates of the chain links which are not connected to the gripper bar 1. In the respective section of the special fitting plate 8 that has the remaining part of the thickness, there is provided a drilled hole 10, which aligns with a respective drilled hole 11 formed in the coupling member 4', which is connected to the gripper bar 1 in a manner analogous to the coupling member 4 according to FIG. 1. The respectively aligned drilled holes 10 and 11 accept a respective pin 12, which is displaceable in the drilling direction in at least one of the respectively aligned drilled holes 10 and 11. The pins 12 bridge the expansion joint 7 provided between the coupling member 4' and the special fitting plate 8.

It is not imperative that the pins 12 align with a respective link pin of the special fitting plate 8, as is illustrated in FIG. 2, but it is particularly advantageous when the diameter of the aligned drilled holes 10 and 11, and hence of the pins 12, is selected to be so large that, in the case of a non-releasable connection between the chain links, the link pins thereof are peened over or riveted.

The configurations described in this regard have a first concept of the connection between one of the conveyor chains and the gripper bar 1 inasmuch as this connection imparts to the gripper bar 1 and 1', respectively, only the degree of freedom of displacement in the longitudinal direction thereof with respect to this conveyor chain. In contrast, the configurations described hereinbelow have a further degree of freedom, specifically that of swivelling or pivoting the gripper bar about a longitudinal axis thereof.

Figure 3:
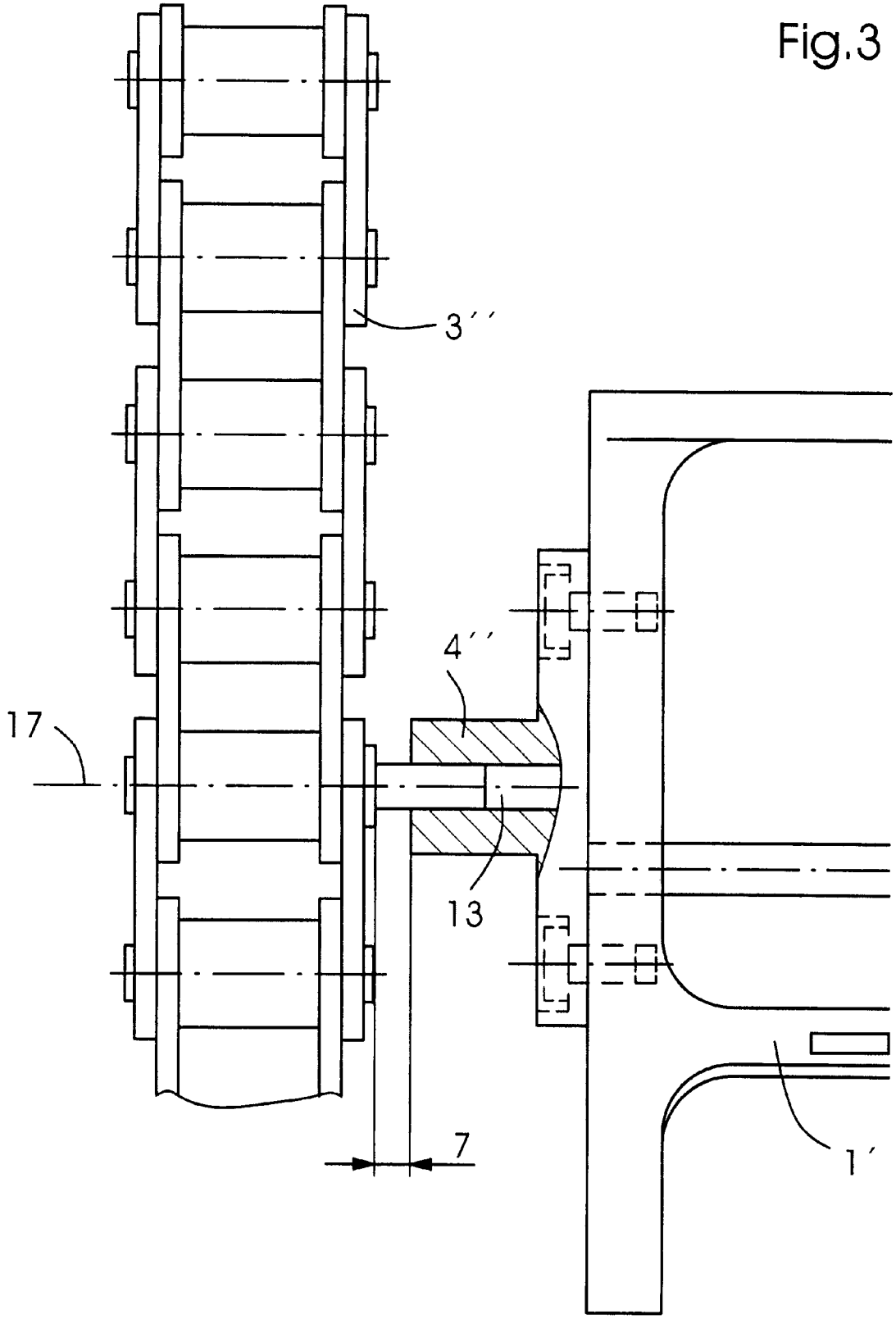
FIG. 3 is a view like those of FIGS. 1 and 2 showing a first exemplary embodiment of a second conception of the connection having the expansion joint and having a further degree of freedom.

FIG. 3 shows a first exemplary embodiment of a second concept of the connection, having this further degree of freedom which, in accordance with the explanations hereinbefore with respect to the forces to be absorbed by the link pins, constitutes a preferred configuration for use in the case of small-format printing presses.

In this regard, the connection is produced by only one link pin which, as in the case of the exemplary embodiment according to FIG. 1, has an added length. In the longitudinal direction, the elongated link pin engages displaceably in a drilled hole 13 formed in the coupling member 4", which is connected to the gripper bar 1' in a manner analogous to that in the exemplary embodiment according to FIG. 1. Accordingly, the connection between the conveyor chain 3" and the gripper bar 1' has, in addition to the degree of freedom provided by the longitudinally displaceable accommodation of the additional length of the link pin used for the connection, a further degree of freedom based upon an articulated connection.

Because the connection between the conveyor chain 3" and the gripper bar 1' is produced by only one link pin, it is also possible for all of the chain links to be constructed with a mutually identical spaced distance between the chain rollers thereof.

Figure 4:
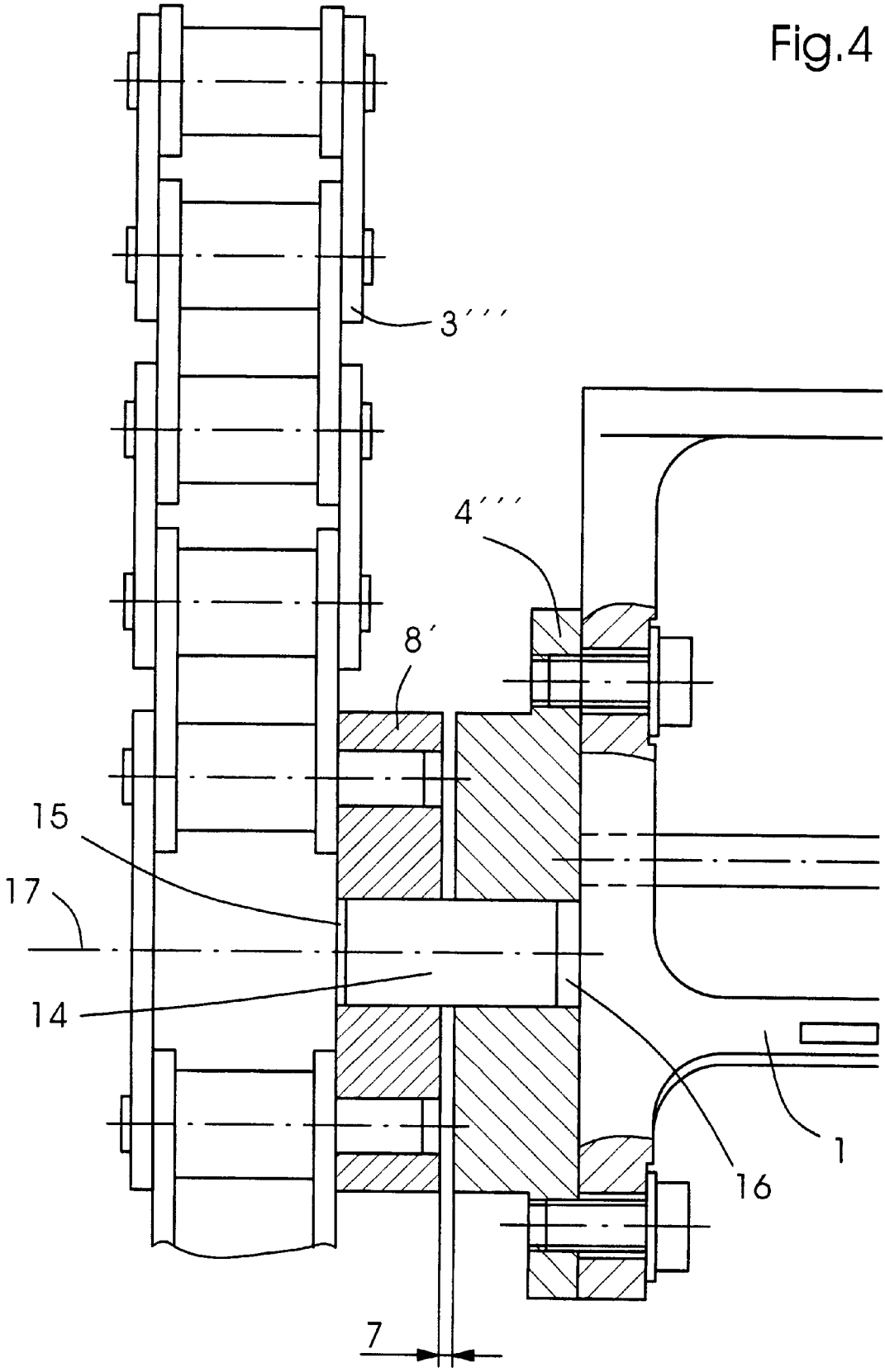
FIG. 4 is a view like those of FIGS. 1 to 3 showing a second exemplary embodiment of the second conception of the connection.

The conveyor chain 3" of the exemplary embodiment according to FIG. 4 is in turn provided with a special chain link having the previously described increased spaced distance between the link pins thereof which, for their part, in turn, have an added length and are jointly involved in absorbing the forces described in the introduction hereto. This exemplary embodiment therefore again constitutes a preferred configuration for use in large-format printing presses, and with a joint or articulation in the connection having the expansion joint 7, this exemplary embodiment likewise has the further degree of freedom mentioned hereinbefore.

In this regard, the joint is realized by a special fitting plate 8' that is carried by the added lengths of the link pins of the special chain link, a coupling member 4'" that is connected to the gripper bar 1 in a manner analogous to the exemplary embodiment of FIG. 1, and a swivel or pivot pin 14, which is accommodated at one end thereof in a drilled hole 15 formed in the special fitting plate 8' and at the other end thereof in a drilled hole 16 formed in the coupling member 4'", the pivot pin 14 being longitudinally displaceable in at least one of the drilled holes 15 and 16, and bridging the expansion joint 7.

The expansion joint 7 is formed between the coupling member 4'" and the special fitting plate 8', and the added lengths of the link pins carrying the special fitting plate 8' are connected to the latter by a press fit.

Deviating therefrom, a non-illustrated exemplary embodiment is also possible wherein the added lengths of the link pins are connected to the special fitting plate 8' via a clearance fit, and the special fitting plate 8' is displaceable with respect to the link pins in the longitudinal direction of the added lengths of the latter, while the pivot pin 14 is secured against axial displacement with respect to the special fitting plate 8' and the coupling member 4'". In this regard, the expansion joint 7 would have to be provided between the special fitting plate 8' and those fitting plates which are assigned to the link pins provided with the added lengths.

Figure 5:
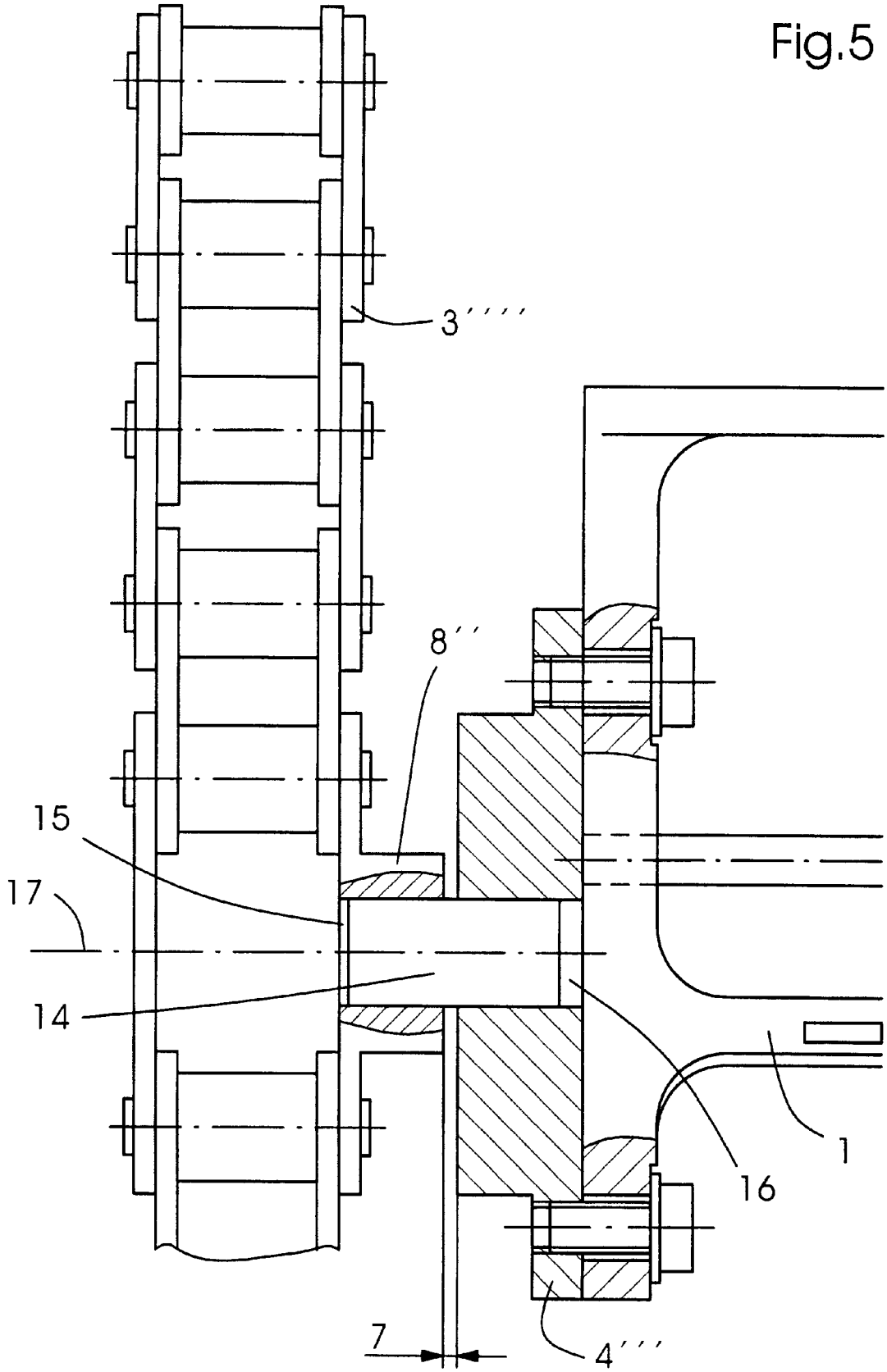
FIG. 5 is a view like those of FIGS. 1 to 4 showing a third exemplary embodiment of the second conception of the connection.

The exemplary embodiment illustrated in FIG. 5 differs from that of FIG. 4 in the shape of the special fitting plate 8". The latter has a thickness which is increased with respect to the thickness of the fitting plates of the chain links which are not connected to the gripper bar, but only in a region accommodating the pin 14 of the special fitting plate 8", so that no link pins with added lengths are needed in order to form the conveyor chain 3"".

In all of the configurations having the aforementioned further degree of freedom according to FIGS. 3 to 5, all of the connections in common between the respective conveyor chain 3", 3'" and 3"" and the gripper bar 1 and 1', respectively, is produced by a swivel joint or pivot having a swivel or pivot axis 17 that is oriented in the longitudinal direction of the gripper bar 1 and 1', respectively.

In preferred configurations, in the case of the exemplary embodiments having gripper bars carried by two link pins, the vector sum of all the forces acting upon the gripper bar 1 is located between these link pins. Furthermore, in the case of the exemplary embodiments which are equipped with a pivot or swivel joint having gripper bars 1 carried by two link pins, the pivot axis 17 is located between these link pins.

Figure 6:
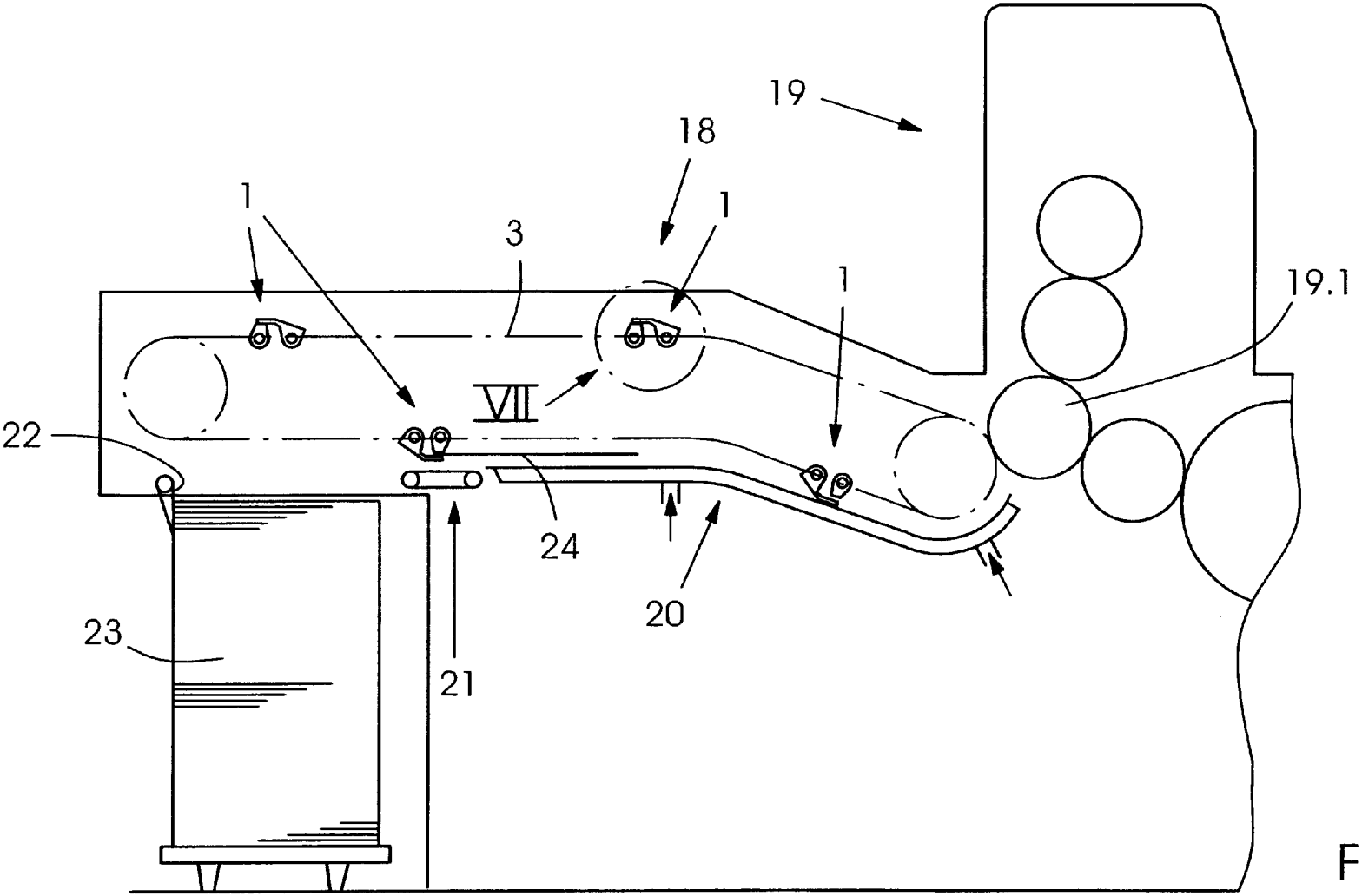
FIG. 6 is a fragmentary diagrammatic side elevational view of a sheet-processing printing press having a delivery equipped with the chain conveyor according to the invention.

FIG. 6 offers an example of the integration of the chain conveyor, described in this respect by preferred configurations, in a printing press that processes sheets 24. The printing press generally has a number of processing stations in the form of printing units and, if appropriate, finishing units, such as varnishing units, and a delivery which adjoins the latter. In the example at hand, the delivery 18 adjoins a last processing station in the form of a printing unit 19 operating in accordance with an offset process. It is also equally possible for the last processing station to be a varnishing unit.

By way of example, the delivery 18 is equipped with a chain conveyor corresponding to that of FIG. 1, and fitted with a number of gripper bars 1, which take over successive sheets 24 from the impression cylinder 19.1 of the printing unit 19, transport them along a sheet guiding device 20, feed them to a sheet brake 21 and, after they have been taken over by the latter, release the sheets, the sheet brake 21, for its part, releasing the sheets 24 after they have been braked to a depositing speed, so that the sheets finally impact or strike against leading-edge stops 22 and form a pile 23 which is aligned by the leading-edge stops 22 and by non-illustrated trailing-edge stops.

For further consideration, let it be imagined that, of the conveyor chains which are arranged opposite one another and which revolve together during operation, the conveyor chain that runs foremost in the illustration in FIG. 6 has been omitted, and the conveyor chain which is reproduced in the form of an oversized detail runs hindmost and is otherwise illustrated in phantom, i.e., by a dot-dash line, is that conveyor chain 3 which is connected to a respective gripper bar 1 in the manner described hereinbefore. In FIG. 6, which offers only an overview, the gripper bars 1 are represented by a likewise oversized diagrammatic illustration of the grippers carried by the gripper bars. This diagrammatic illustration is intended to indicate only the connection, provided here by way of example in accordance with FIG. 1, between a respective gripper bar 1 and the conveyor chain 3, and hence, in particular, the coupling of the gripper bars 1 to two link pins, respectively.

Figure 7:
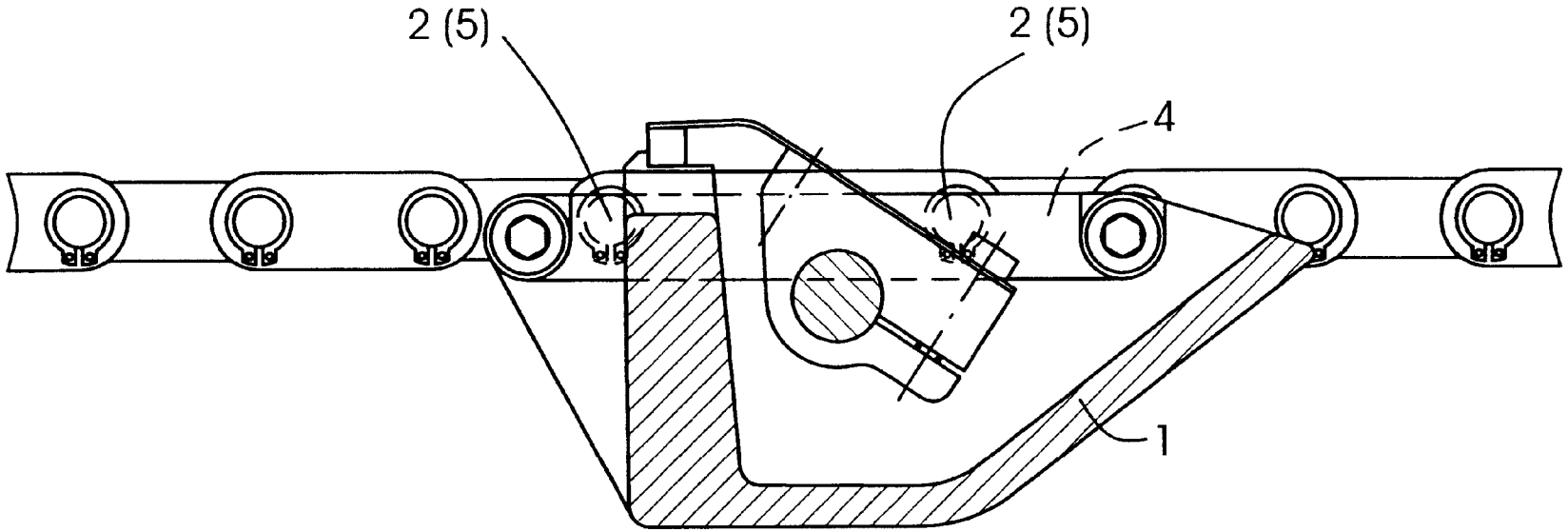
FIG. 7 is a much-enlarged fragmentary sectional view of FIG. 6 showing in detail the gripper bar and associated equipment illustrated within the circle VII shown in phantom.

FIG. 7 shows one of the gripper bars 1 indicated only in the aforementioned manner in FIG. 6, from the same viewing direction as in the case of FIG. 6, in a more detailed illustration in the form of a section having the course specified in FIG. 1 by the line S.

The field of use of the chain conveyor which has been described in this respect and illustrated in connection with a delivery is not restricted to a delivery, but also includes the transfer of sheets between processing stations of the printing press, if chain conveyors are provided therefor instead of transfer drums.

We claim:

1. A chain conveyor for transporting sheets in a printing press, comprising:

two conveyor chains disposed opposite one another and revolving together during operation;

at least one gripper bar having an end and extending in a direction transverse to and between said two conveyor chains; and an expansion joint connecting said end of said gripper bar to one of said conveyor chains and allowing movement of said gripper bar in the direction transverse to said two conveyor chains.

2. The chain conveyor according to claim 1, wherein said expansion joint allows rotational movement of said gripper bar.

3. In a sheet-processing printing press, a chain conveyor for transporting sheets in the printing press, comprising:

two conveyor chains disposed opposite one another and revolving together during operation;

at least one gripper bar having an end and extending in a direction transverse to and between said two conveyor chains; and an expansion joint connecting said end of said gripper bar to one of said conveyor chains and allowing movement of said gripper bar in the direction transverse to said two conveyor chains.

* * * * *